US007080456B2

(12) United States Patent
Wu

(10) Patent No.: US 7,080,456 B2
(45) Date of Patent: Jul. 25, 2006

(54) KNIFE ASSEMBLY

(76) Inventor: Race Wu, 13F-2, No. 9, Lane 336, Chin Hua N. Rd., Taichung (TW)

( * ) Notice: Subject to any disclaimer, the term of this patent is extended or adjusted under 35 U.S.C. 154(b) by 43 days.

(21) Appl. No.: 10/900,201

(22) Filed: Jul. 28, 2004

(65) Prior Publication Data

US 2006/0021229 A1 Feb. 2, 2006

(51) Int. Cl.
*B26B 29/02* (2006.01)

(52) U.S. Cl. ..... 30/151; 30/162; 224/232

(58) Field of Classification Search ..... 30/151, 30/162; 224/232; 206/349; 24/614, 615
See application file for complete search history.

(56) References Cited

U.S. PATENT DOCUMENTS 4,558,516 A * 12/1985 Collins ..... 30/151
5,067,239 A * 11/1991 Collins ..... 30/151
5,123,167 A * 6/1992 Kelley ..... 30/151
5,138,768 A * 8/1992 Collins ..... 30/151
5,255,436 A * 10/1993 Yoshida ..... 30/151
5,315,761 A * 5/1994 Norton et al. ..... 30/162
5,379,520 A * 1/1995 Collins ..... 30/162
5,647,130 A * 7/1997 Collins ..... 30/151
5,794,347 A * 8/1998 Serpa ..... 30/162
5,915,793 A * 6/1999 Serpa ..... 30/162
5,926,959 A * 7/1999 Collins ..... 30/162
6,138,363 A * 10/2000 Kawashima ..... 30/151
6,442,843 B1 * 9/2002 Jue et al. ..... 30/151

* cited by examiner

*Primary Examiner*—Hwei-Siu Payer
(74) *Attorney, Agent, or Firm*—Browby and Neimark, PLLC

(57) ABSTRACT

A knife assembly has a knife having a blade, a handle at an end of the blade and a lock portion on the handle. A rigid sheath has an elongated bottom wall and two upright side-walls, between which is a slot o receive the blade of the knife. Two lock devices are provided in a recess of the sheath for movement between a lock position, in which rods of the lock devices are engaged with the lock portion of the knife to secure the knife, and an unlock position, in which the rod of the lock devices are disengaged with the lock portion of the knife. An ejector is provided on the sheath to eject the handle of the knife out while the lock devices release the knife.

9 Claims, 9 Drawing Sheets

KNIFE ASSEMBLY

BACKGROUND OF THE INVENTION

1. Field of the Invention

The present invention relates generally to a knife, and more particularly to a knife assembly for outdoor activities, such as mountain-climbing and diving, which is easier to pull the knife out of the sheath.

2. Description of the Related Art

Knife is a common equipment for some outdoor activities, such as mountain-climbing and diving. We always see a climber or a diver carrying a knife on his/her waist or on the interior side of thigh. The knife is put in a sheath and the sheath usually has a fastener, such as buckle, to secure the knife.

While the user needs the knife, he/she releases the fastener of the sheath first and pulls the knife out. Some users complaint that it is inconvenient to pull the out of the sheath and the fastener of the sheath sometime interferes the action of pulling the knife.

SUMMARY OF THE INVENTION

The primary objective of the present invention is to provide a knife assembly, which is easier to pull the knife out of the sheath.

According to the objective of the present invention, a knife assembly comprises a knife having a blade, a handle at an end of the blade and a lock portion on the handle. A rigid sheath has an elongated bottom wall and two upright sidewalls, between which a slot is formed. Each of the sidewalls have a restricting portion over the slot and the blade of the knife is received in the slot and under the restricting portions. At least a lock device is provided on the sheath for movement between a lock position, in which the lock device is engaged with the lock portion of the knife to secure the knife to the sheath, and an unlock position, in which the lock device releases the lock portion of the knife to take the knife out of the sheath.

DETAILED DESCRIPTION OF THE INVENTION

Figure 1:
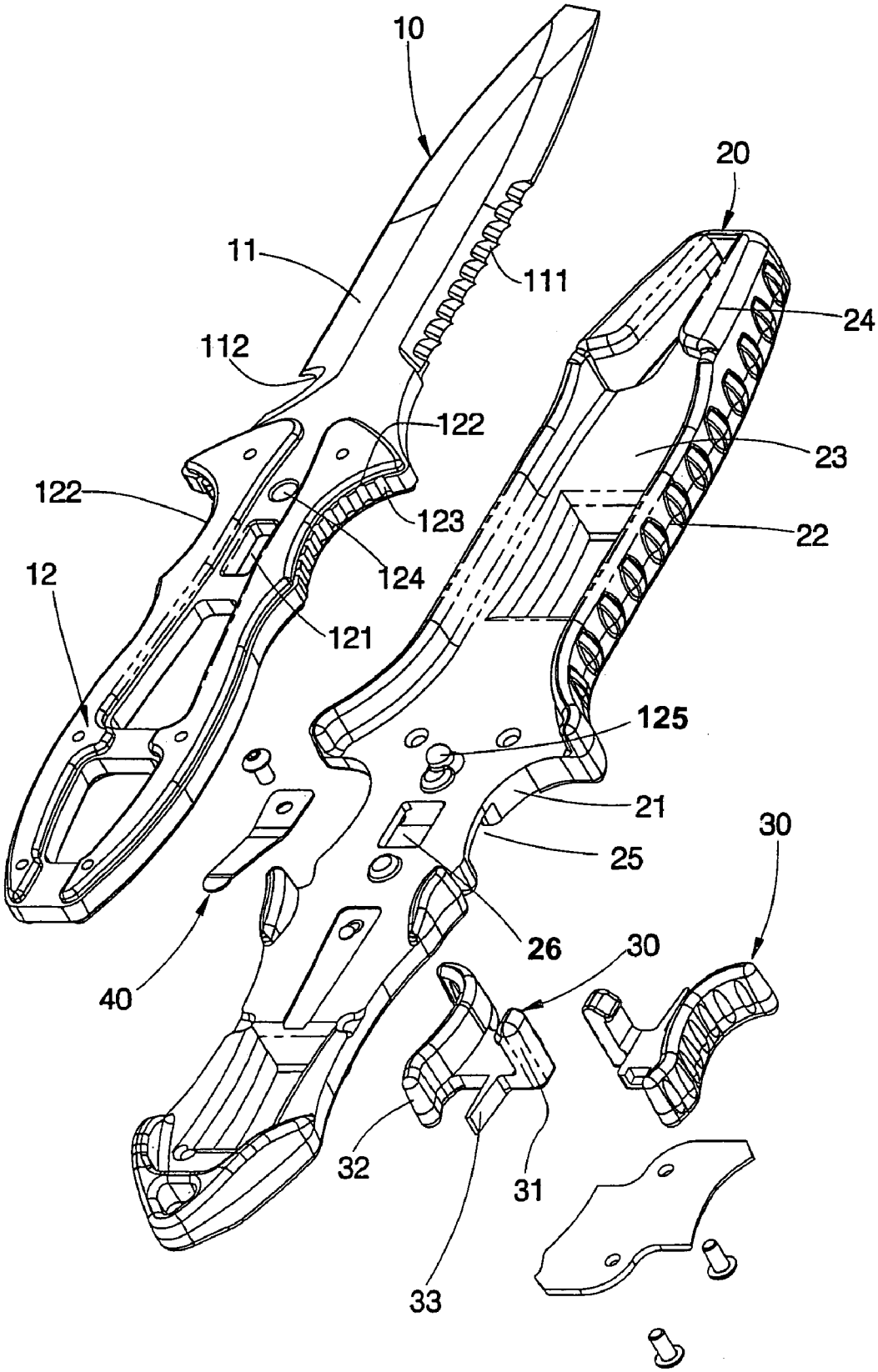
FIG. 1 is an exploded view of a preferred embodiment of the present invention.
Figure 2:
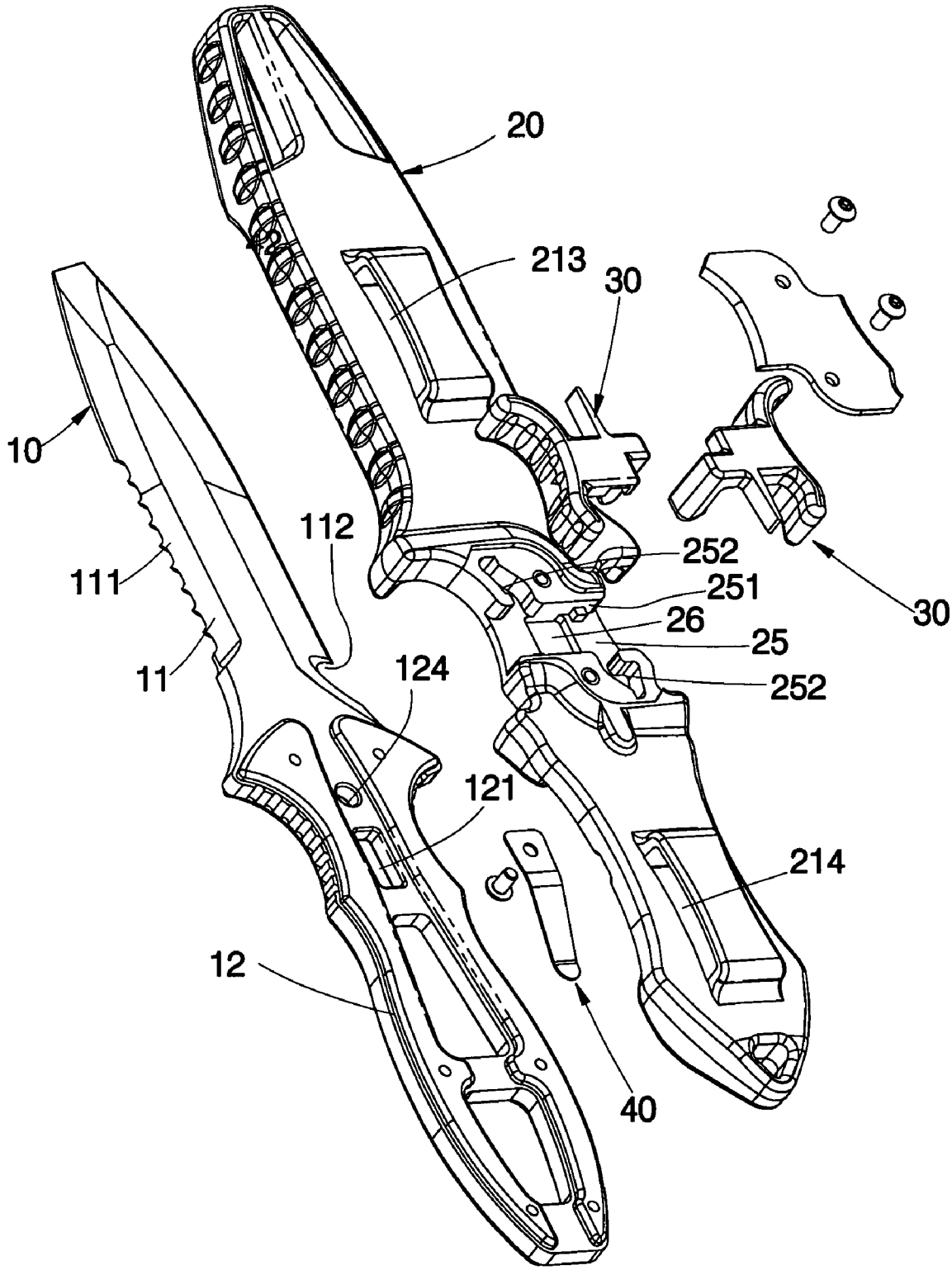
FIG. 2 is another exploded view of the preferred embodiment of the present invention.
Figure 3:
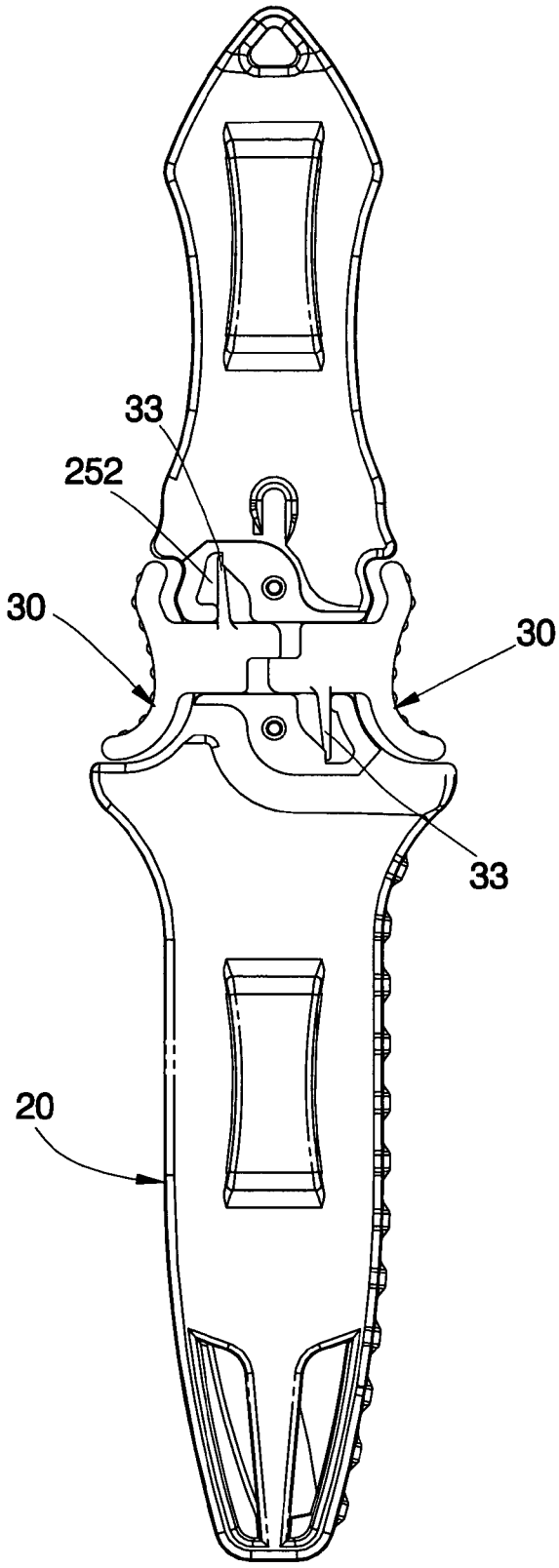
FIG. 3 is a rear view of the sheath of the preferred embodiment of the present invention.
Figure 4:
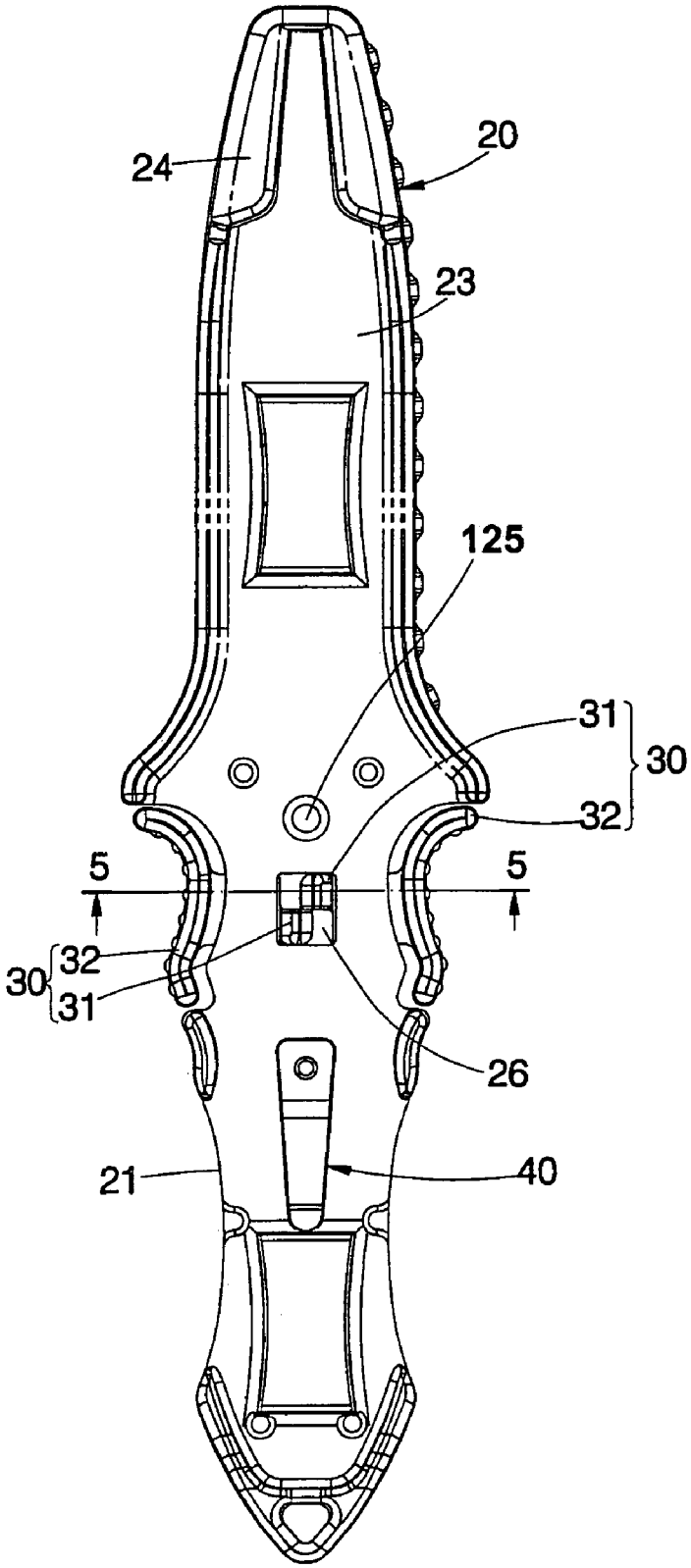
FIG. 4 is a front view of the sheath of the preferred embodiment of the present invention.
Figure 5:
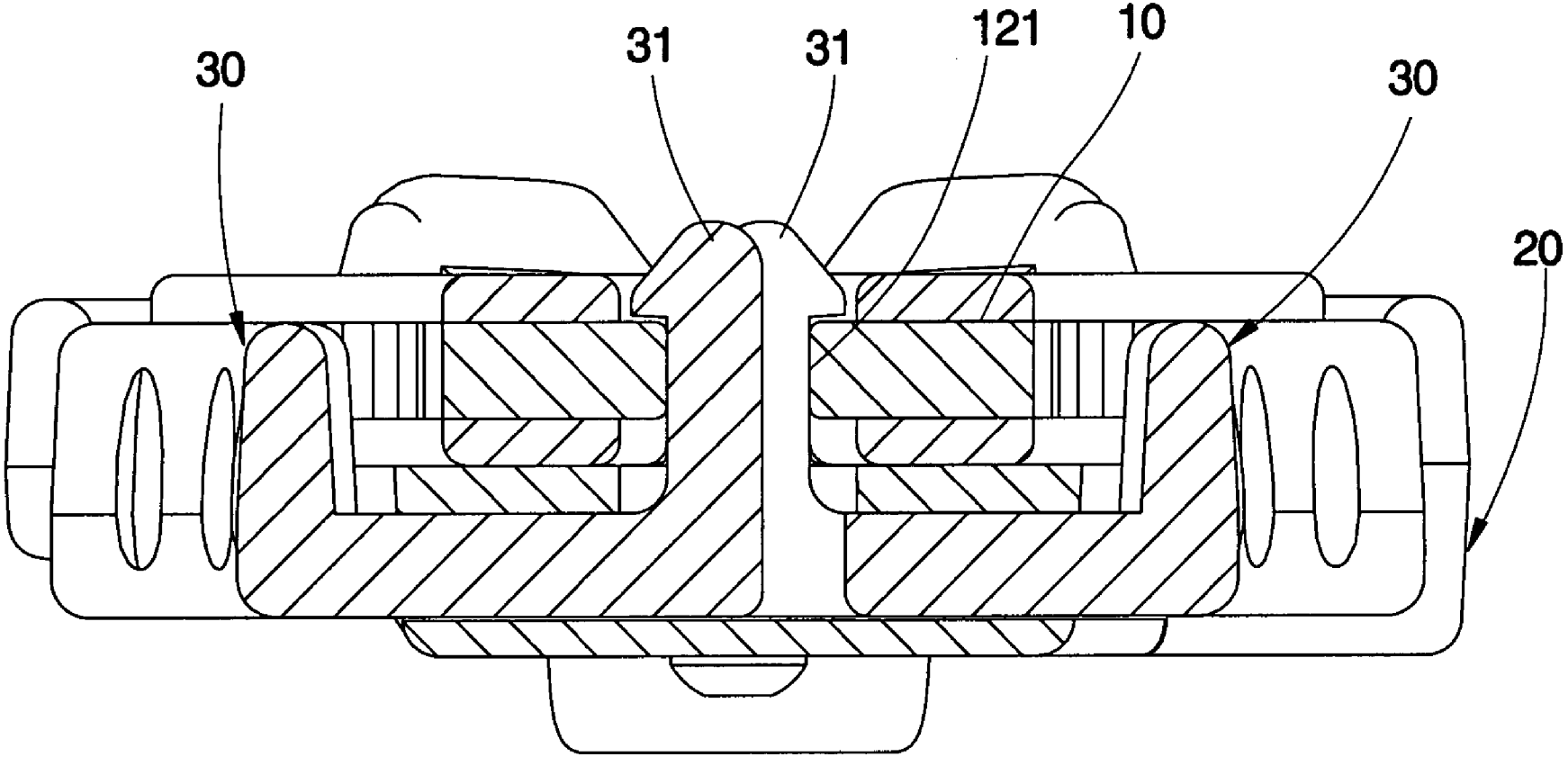
FIG. 5 is a sectional view along the 5—5 line of FIG. 4.

As shown in FIGS. from FIG. 1 to FIG. 3, a knife assembly of the preferred embodiment of the present invention comprises:

A knife 10 has a blade 11 and a handle 12 at an end of the blade 11. The blade 11 has a sawtooth portion 111 and a hook portion 112 at an edge thereof. The handle 12 has a lock portion 121, which is a hole in the present preferred embodiment, and two flanges 122 with texture 123 adjacent to the blade 11. The textures 123 of the flanges 122 provide friction, while the user holds the handle 12.

A rigid sheath 20 has an elongated bottom wall 21 two sidewalls 22 projected from opposite sides of the bottom wall 21, between which a slot 23 is formed to receive the blade 11 of the knife 10. The sidewalls 22 each has a restricting portion 24, which are projected inwardly from the sidewall 22 to cover a portion of the blade 11 adjacent to a tip end thereof. The restricting portions 24 keep the tip end of the blade 11 in the slot 23. The sheath 20 further has a recess 25 and a hole 26 at a bottom of the recess 25 on a bottom side of the bottom wall 21. The recess 25 is open at the opposite sides of the bottom wall 21 and has two walls 251. Two gaps 252 are formed on the bottom side of the bottom wall 21 at opposite sides of the recess 25 respectively. The gaps 252 are communicated with the recess 25 respectively.

Figure 6:
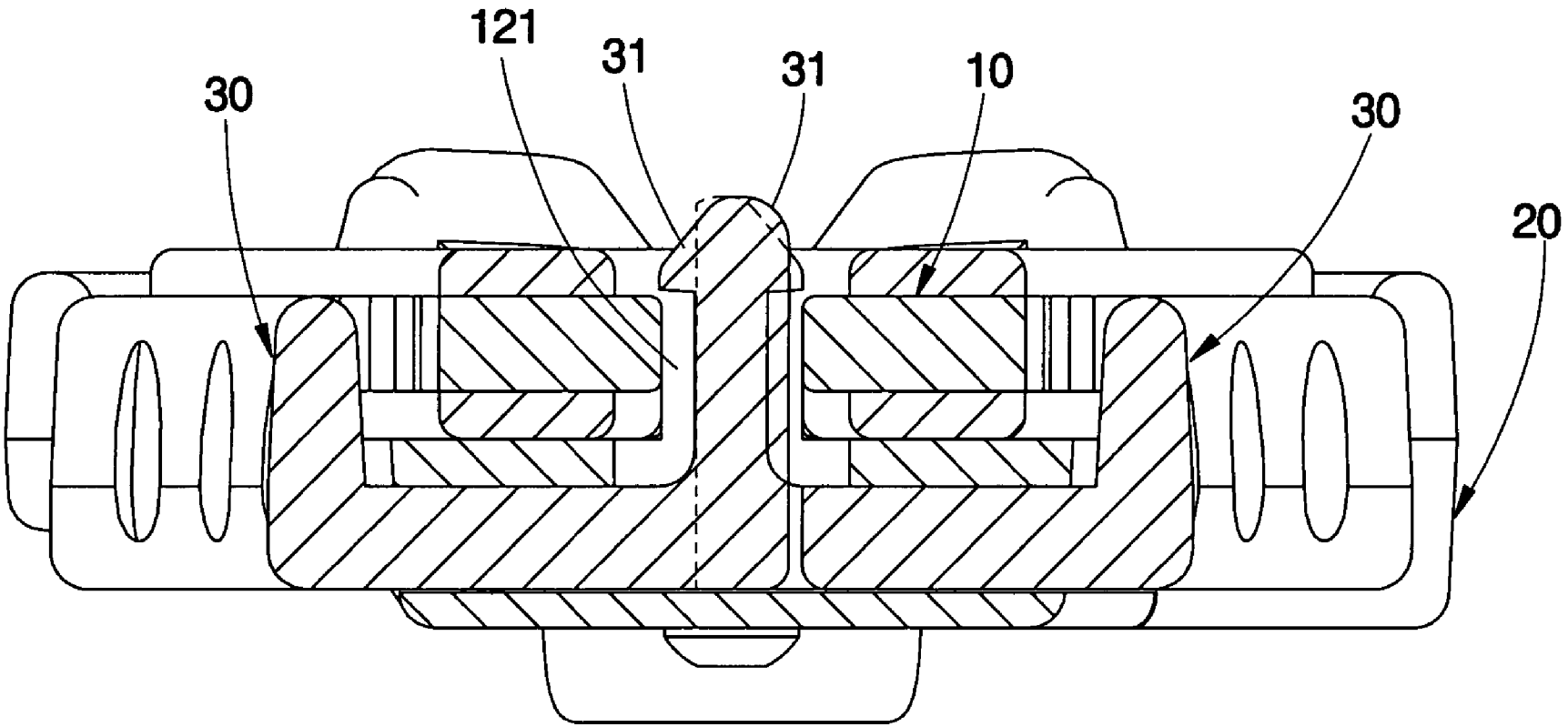
FIG. 6 is a sectional view similar to FIG. 5, showing the releasing action.

As shown in FIG. 3 to FIG. 6, two lock devices 30 is provided in the recess 25 of the sheath 20, each of which has a rod 31 with a hook at a distal end and a pressing plate 32 respectively at opposite ends thereof. The rods 31 of the lock devices 30 are extruded into the slot 23 via the hole 26. The pressing plates 32 of the lock devices are positioned at the opposite open ends of the recess 25 respectively. The lock devices 30 each has a return member 33 received in the gaps 252 respectively. The return members 33 keep the lock devices 30 in an initial position, so called a lock position, as shown in FIG. 3. While the pressing plates 32 of the lock devices 30 are pressed, the lock devices 30 move toward to an unlock position. The knife 10 is put on the sheath 20 to receive the blade 11 in the slot 23 and to receive the rods 31 in the lock portion 121 while the lock devices 30 are moved to the lock position, such that the knife 10 is secured firmly to the sheath 20. On the contrary, as shown in FIG. 6, while the pressing plates 32 are pressed to move the lock devices to the unlock position, the rods 31 are no longer restricted in the lock portion 121 and the knife 10 is free to be pulled out of the sheath 20. It has to be mentioned that the return members 33 of the lock devices 30 can be spring or other equivalent elements to replace the plate elements in the present preferred embodiment.

An ejector 40 is an elastic plate with an end fastened on the bottom wall 21 of the sheath 20 and a free end suspended in the present preferred embodiment. The handle 12 of the knife 10 presses the free end of the ejector 40 down while the knife 10 is secured to the sheath 20. The ejector 40 ejects the handle 12 of the knife 10 out while the lock devices 30 are moved to the unlock position and the knife 10 is free to take out.

Figure 7:
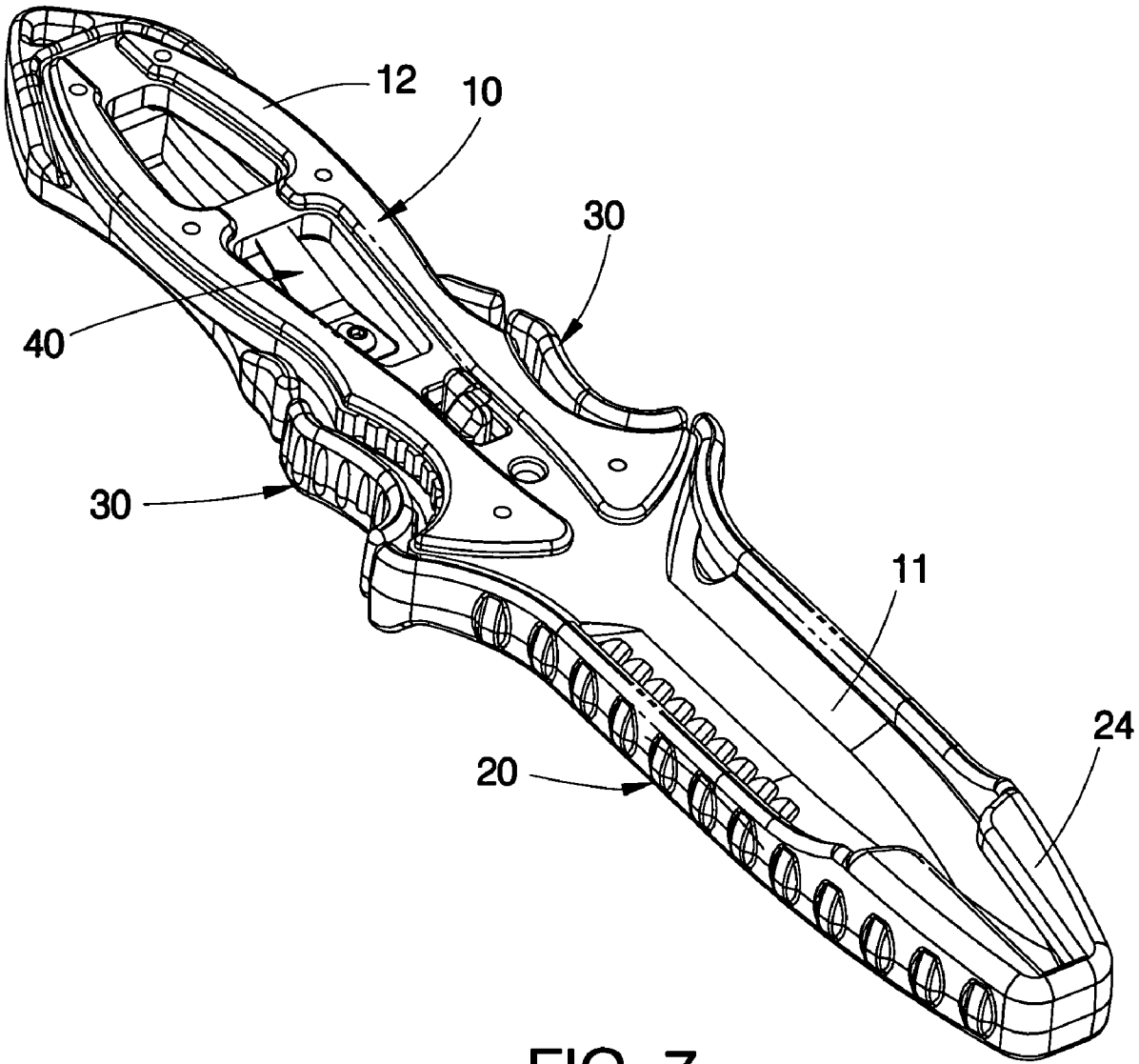
FIG. 7 is a perspective view of the preferred embodiment of the present invention.
Figure 8:
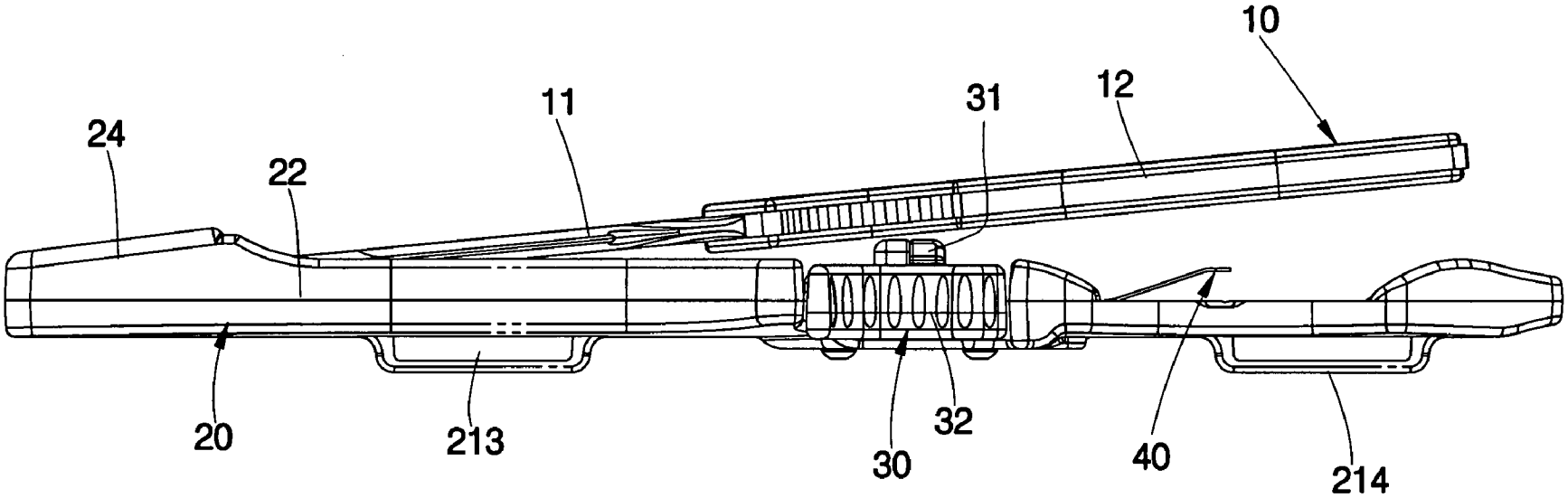
FIG. 8 is a lateral view of the preferred embodiment of the present invention, showing the knife member being ejected.

As shown in FIG. 7 and FIG. 8, in storage, the tip end of the blade 11 of the knife 10 is inserted into the slot 23 of the sheath 20 under the restricting portions 24 first, and then the handle 12 is moved downward to the bottom wall 21 of the sheath 20. In the meantime, the lock portion 121 on the handle 12 is engaged with the rods 31 of the lock devices 30 to secure the knife 10 automatically. While the user needs the knife 10, he/she just presses the pressing plates 32 of the lock devices 30 to move them to the unlock position. The hooks of the rods 31 are no longer engaged with the knife 10 and the ejector 40 ejects the handle 12 upward, as shown in FIG. 8. In this condition, the handle 12 of the knife 10 is tilted that facilitates user holding the handle 12 easily to pull the knife 10 out of the sheath 20.

Figure 9:
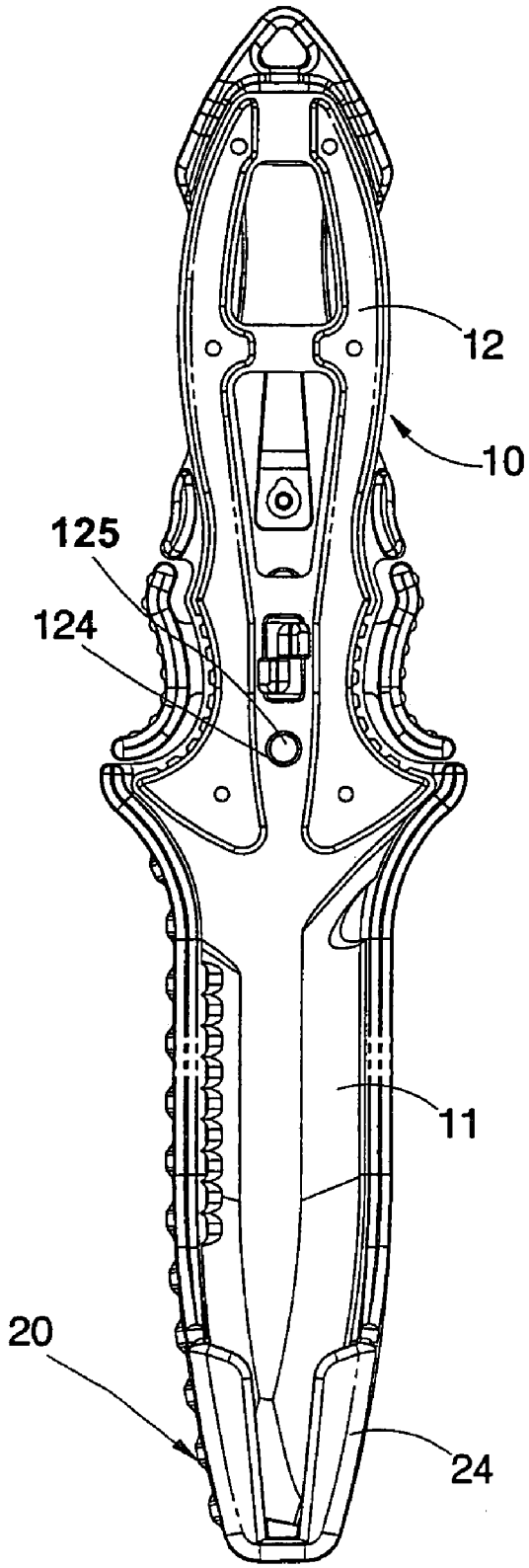
FIG. 9 is a front view of the preferred embodiment of the present invention.

The ejector 40 is provided to make the knife 10 pulled out of the sheath 20 faster and easier and it is not an essential element in the present invention. As shown in FIG. 1 and FIG. 2, the sheath 20 is provided with two holes 213 and 214. A belt or a rope (not shown) runs through the holes 213 and 214 to fasten the sheath 20 on user's body. As shown in FIG. 9, the knife 10 has a first engagement member 124 on the handle 12 and the sheath 20 has a second engagement member 125 to be engaged with the first engagement member 124 while the knife 10 is put in the sheath 20. The engagement members 124 and 125 makes the knife 10 not moving in the slot 23 of the sheath 20 to prevent the blade 11 of the knife 10 from damaging the sheath 20.

In addition, the handle 12 has a portion out of the sheath 20 while the knife 10 is put in the sheath 20 that facilitates user to grip the handle 12. In practice, the lock portion 121 can be a slot (not shown) but a hole, which means it is open at an end and close at the other end rather than it is open at opposite ends in the present preferred embodiment.

What is claimed is:

1. A knife assembly, comprising:

a knife having a blade, a handle at an end of the blade and a lock portion on the handle;

a rigid sheath having an elongated bottom wall and two upright sidewalls, between which a slot is formed, wherein each of the sidewalls has a restricting portion over the slot and the blade of the knife is received in the slot and under the restricting portions, and at least one lock device provided on the sheath for movement between a lock position, in which the lock device is engaged with the lock portion of the knife to secure the knife, and an unlock position, in which the lock device is disengaged with the lock portion of the knife, so that the knife is free to be taken out of the sheath, wherein the lock device has a rod and a pressing plate and the pressing plate is extruded out of the sheath for manipulation of the lock device and the lock portion of the knife is a hole or a slot to be detachably engaged with the rod of the lock device.

2. The knife assembly as defined in claim 1, further comprising an ejector provided on the bottom wall of the sheath, wherein the handle of the knife presses the ejector while the knife is secured by the lock device and the ejector ejects the handle of the knife out while the lock device releases the knife.

3. The knife assembly as defined in claim 2, wherein the ejector is a plate having an end fixed on the bottom wall of the sheath and a free end suspended.

4. The knife assembly as defined in claim 1, wherein the lock device further has a return member to move the lock device to the lock device.

5. The knife assembly as defined in claim 4, wherein the sheath has a recess, in which the lock device is received, on a bottom side of the bottom wall and a hole at a bottom of the recess, in which the rod of the lock device passes.

6. The knife assembly as defined in claim 5, wherein the return member is an elastic plate projected from the lock device and a distal end thereof is against the sheath.

7. The knife assembly as defined in claim 1, wherein the knife has a first engagement portion on the handle and the sheath has a second engagement portion to be engaged with the first engagement portion while the knife is put in the sheath.

8. The knife assembly as defined in claim 1, wherein the handle of the knife has two flanges, on each of which a texture is provided.

9. The knife assembly as defined in claim 1, wherein the handle of the knife has a portion extruded out of the sheath while the knife is put in the sheath.

* * * * *